US011261012B2

(12) United States Patent
Loritz

(10) Patent No.: US 11,261,012 B2
(45) Date of Patent: Mar. 1, 2022

(54) SECURED STORAGE APPARATUS

(71) Applicant: Kenneth Anthony Loritz, Irvine, CA (US)

(72) Inventor: Kenneth Anthony Loritz, Irvine, CA (US)

( * ) Notice: Subject to any disclaimer, the term of this patent is extended or adjusted under 35 U.S.C. 154(b) by 1413 days.

(21) Appl. No.: 15/034,794

(22) PCT Filed: Nov. 5, 2014

(86) PCT No.: PCT/US2014/064076
§ 371 (c)(1),
(2) Date: May 5, 2016

(87) PCT Pub. No.: WO2015/069730
PCT Pub. Date: May 14, 2015

(65) Prior Publication Data

US 2016/0288969 A1 Oct. 6, 2016

Related U.S. Application Data

(60) Provisional application No. 61/900,268, filed on Nov. 5, 2013.

(51) Int. Cl.

| | |
|---|---|
| ***B65D 55/02*** | (2006.01) |
| ***B65D 55/14*** | (2006.01) |
| ***B65D 77/04*** | (2006.01) |
| ***A61J 1/14*** | (2006.01) |
| ***B65D 41/04*** | (2006.01) |

(52) U.S. Cl.
CPC ..... *B65D 55/14* (2013.01); *A61J 1/1437* (2013.01); *B65D 41/0435* (2013.01); *B65D 55/02* (2013.01); *B65D 77/0486* (2013.01)

(58) Field of Classification Search
CPC ..... B65D 55/12; B65D 55/14; B65D 55/02; B65D 55/145; B65D 55/16; B65D 77/0486; A61J 1/1437
USPC ..... 206/1.5; 215/206
See application file for complete search history.

(56) References Cited

U.S. PATENT DOCUMENTS

| | | | | |
|---|---|---|---|---|
| 3,213,653 | A * | 10/1965 | Probasco | G07F 9/10 70/166 |
| 4,457,438 | A * | 7/1984 | Varlet | B65D 41/3438 215/252 |
| 4,870,842 | A | 10/1989 | Plumer | |
| 5,934,099 | A * | 8/1999 | Cook | A61J 1/165 62/457.2 |
| 6,912,878 | B2 | 7/2005 | Belden, Jr. | |

(Continued)

OTHER PUBLICATIONS

PCT/US2014/064076, International Search Report and Written Opinion, Jan. 27, 2015.

*Primary Examiner* — King M Chu
(74) *Attorney, Agent, or Firm* — Fay Sharpe LLP

(57) ABSTRACT

A secured storage apparatus includes a sleeve that receives a container/cap assembly therein. The sleeve includes a lock that selectively secures the container/cap assembly and the cap cannot be removed from the container when the assembly is locked in the sleeve. In one arrangement, the cap and sleeve include ribs that prevent rotation of the cap relative to the sleeve. In another arrangement, the container and cap of the assembly freely rotate together in assembled relation within the sleeve, but the cap cannot be rotated relative to the container and/or pushed axially relative to the container.

31 Claims, 17 Drawing Sheets

(56) References Cited

U.S. PATENT DOCUMENTS

| | | | | |
|---|---|---|---|---|
| 7,252,204 | B1 | 8/2007 | Small et al. | |
| 2001/0000617 | A1 | 5/2001 | Tracy | |
| 2006/0191947 | A1 | 8/2006 | Jedryk et al. | |
| 2007/0177926 | A1* | 8/2007 | Wang | A45D 40/205<br>401/88 |
| 2010/0038273 | A1* | 2/2010 | Johnson | B65D 25/34<br>206/459.5 |
| 2012/0222980 | A1* | 9/2012 | Lambalot | B65D 51/18<br>206/438 |
| 2013/0043204 | A1 | 2/2013 | Simpson | |

* cited by examiner

SECURED STORAGE APPARATUS

This application is a national filing of International Application PCT/US2014/064076, International Filing Date 5 Nov. 2014 and claims the priority benefit of U.S. Provisional Application No. 61/900,268, filed on Nov. 5, 2013, the disclosures of which are incorporated herein by reference.

FIELD OF THE INVENTION

The field of the invention is secured storage apparatus that are user friendly.

BACKGROUND

The following description includes information that may be useful in understanding the present disclosure. It is not an admission that any of the information provided herein is prior art or relevant to the presently claimed invention, or that any publication specifically or implicitly referenced is prior art.

Secured storage containers have been used to safely store medicine and other sensitive substances in the household. Because many of these substances can be harmful to children, security mechanisms are used to prevent children from gaining access. A common type of security mechanism is a safety cap, which typically requires a combination of compression and torque to remove. Although the safety cap can prevent access to young children, the safety cap can be problematic for seniors and individuals with disabilities to remove the safety cap and can be ineffective to prevent access to older children.

Other security measures have also been used to provide safe storage of sensitive substances, such as a combination lock. US 2013/0043204 to Simpson discloses the use of a dial locking mechanism attached to a cap of a bottle. When the dial locking mechanism receives the right combination, torque can be applied to remove the bottle cap. In another example, U.S. Pat. No. 7,252,204 to Small discloses a combination-locking container having two cylindrical housings, which can hold a variety of objects (e.g., medicine bottles). When a set of tumblers are placed in a correct configuration, internal keyways orient protruding tabs on both housings in an unobstructed manner so that the container can be opened. Although these mechanisms provide a higher level of security by requiring a code, these mechanisms may be burdensome for seniors and individuals with disabilities to memorize the code and manually input the code on a rotating dial.

Other methods of securely locking a container storing sensitive substances include using a key. For example, U.S. Pat. No. 6,912,878 to Belden discloses a bottle security device that has an outer member, which slides over an inner member and locks on the neck of a bottle. To remove the bottle security device, an individual uses a magnetic key on keyholes. This method provides easier access without the need of memorizing a code to input. However, there is a security risk by having the storage area, in this case the body of the bottle, exposed because an individual can break the storage area to access the enclosed substances.

Finally, methods of securing a container include even simpler locking configurations. Canadian Patent Application 2536879 to D'Souza discloses a container having a tubular body, and a cover to fit over the body. The cover locks onto the body by a twisting motion, which causes a tab from the cover to fit into an opening on the tubular body. Although this mechanism is relatively simple to operate, the mechanism may be overly simplistic such that children can gain access to the enclosed substances.

Thus, there is still a need for an improved secured storage container that can be easily accessible, for example, to seniors and individuals with disabilities.

SUMMARY

The present disclosure provides apparatus, systems and methods in which a secured storage container can be used to safely store sensitive substances in a manner that allows seniors and individuals with disabilities to easily gain access. The secured storage apparatus comprises a cap that has a plurality of ribs disposed along the circumference of the cap. The cap can easily engage and disengage a container via a rotational motion (e.g., screw cap assembly). The apparatus further comprises a sleeve that can be slid over the container and the cap. The sleeve has a plurality of ribs that can engage with the plurality of ribs of the cap. When the sleeve is removed from the container and cap, a user can orient the ribs of the cap and the ribs of the sleeve to interlock in order to tighten or loosen the cap from the container by rotating the cap or the sleeve. This option provides an alternative method of removing the cap for users that have difficulty rotating the cap to remove the cap from the container. Finally, the secured storage apparatus comprises a locking mechanism disposed on the sleeve, which could lock the sleeve onto the container. When locked, a user cannot access the inside of the container due to an enclosure created by the surfaces of the sleeve and the cap.

A secured storage apparatus includes a sleeve that receives a container/cap assembly therein. The sleeve includes a lock that selectively secures the container/cap assembly and the cap cannot be removed from the container when the assembly is locked in the sleeve. In one arrangement, the cap and sleeve include ribs that prevent rotation of the cap relative to the sleeve. In another arrangement, the container and cap of the assembly freely rotate together in assembled relation within the sleeve, but the cap cannot be rotated relative to the container and/or pushed axially relative to the container.

The following discussion provides many example embodiments of the present subject matter. Although each embodiment represents a single combination of elements, the present subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the disclosure and does not pose a limitation on the scope of the disclosure otherwise claimed. No language in the specification should be construed as indicating any non-claimed element essential to the practice of the disclosure.

Groupings of alternative elements or embodiments of the disclosure disclosed herein are not to be construed as limitations. Each group member can be referred to and claimed individually or in any combination with other members of the group or other elements found herein. One or more members of a group can be included in, or deleted from, a group for reasons of convenience and/or patentability.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

DESCRIPTION OF THE DRAWINGS

FIGS. 34 and 35 are top and bottom perspective views of another embodiment of a secured storage apparatus having a different aspect ratio.

FIGS. 36 and 37 are top and bottom perspective views of still another embodiment of a secured storage apparatus having a different aspect ratio.

DETAILED DESCRIPTION

Figure 1:
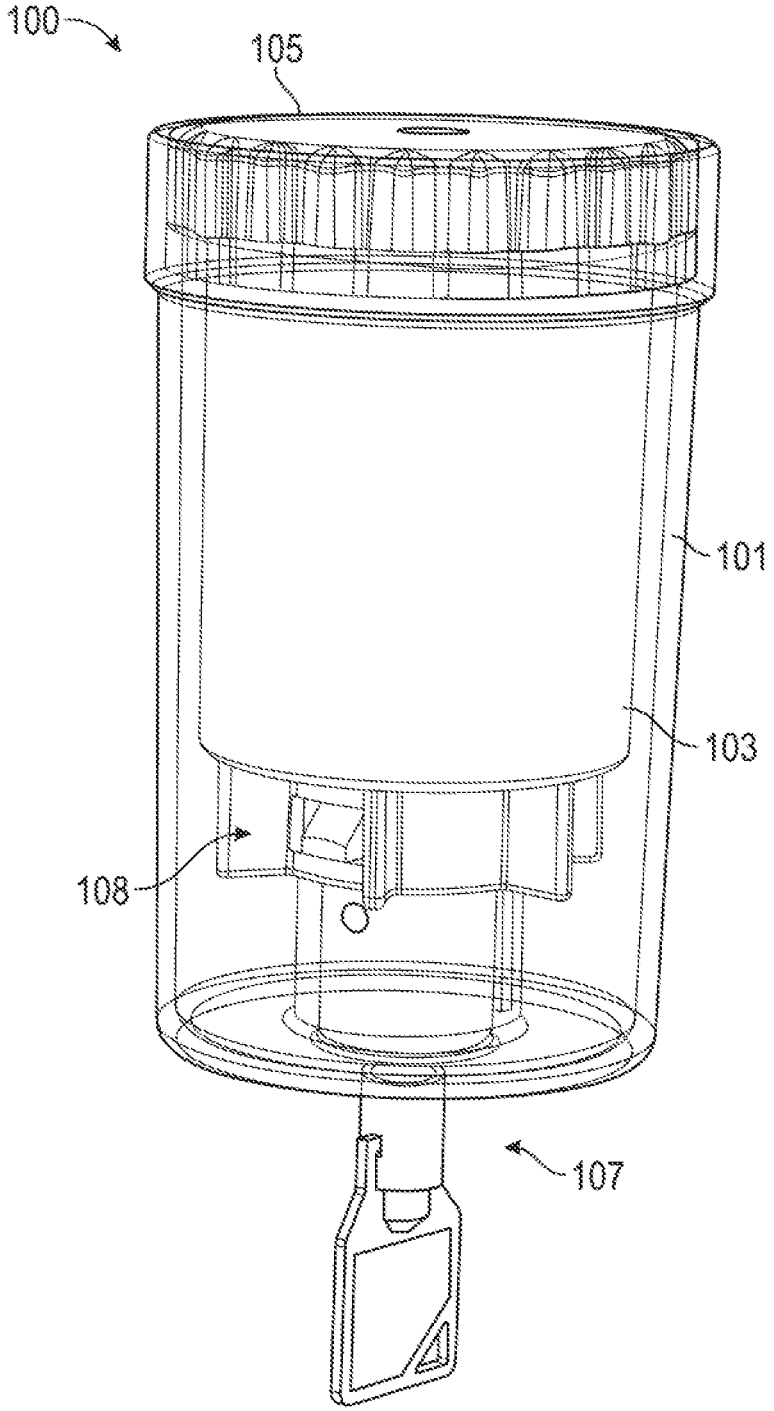
FIG. 1 is a perspective view of a first embodiment of a secured storage apparatus.

FIG. 1 shows an embodiment of a secured storage apparatus 100. Apparatus 100 includes a sleeve 101, which has a plurality of ribs 102. The sleeve 101 of FIG. 1 is shown as having a closed or first end, and an open, second end. Sleeve 101 can be formed from one or more of various materials, such as a metal (e.g., stainless steel, a titanium alloy, or an aluminum alloy) or a polymer (e.g., high-density polyethylene, polycarbonate, or polyvinyl chloride). Preferably, the material of construction of the sleeve 101 is rugged and durable, yet also easy to manufacture such as a molded polymer. In typical embodiments, sleeve 101 is composed of a rigid and strong material to reduce the likelihood of fracture due to impact (e.g., hammer strike) or other forces that are used in an attempt to gain unauthorized access to an enclosed substance stored therein.

Figure 2:
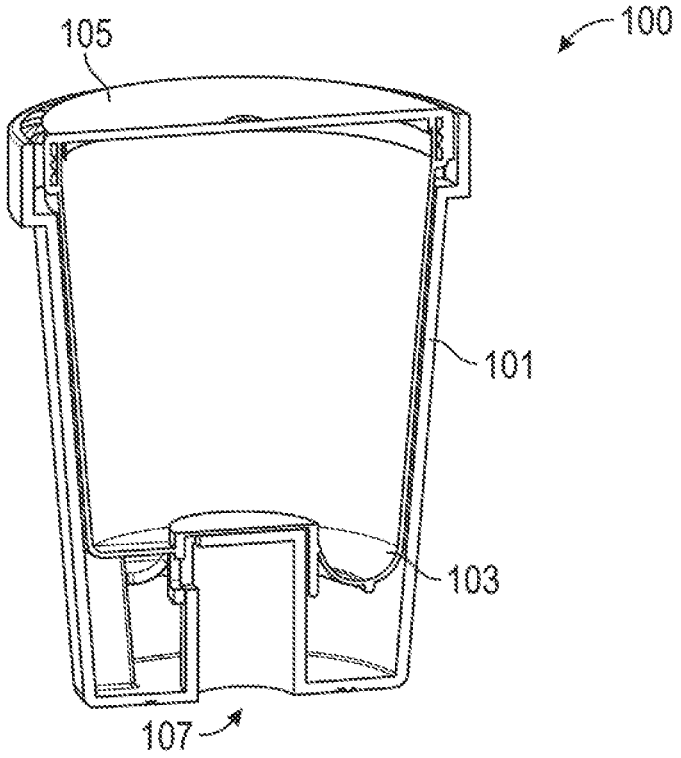
FIG. 2 is a longitudinal, cross-sectional view through the secured storage apparatus of FIG. 1.

Sleeve 101 is preferably sized and dimensioned to receive a container 103 and a cap 105. FIG. 2 shows a cross section of the secured storage apparatus 100 where container 103 and cap 105 are within an inside area of sleeve 101. Container 103 is closed at a lower or first end and open at an upper or second end with a continuous, cylindrical sidewall extending between the ends. In this embodiment, container 103 includes external threads or thread portions 106 that cooperate with an internal threads or thread portions 106 that are provided on the interior of a sidewall of the cap 105. In this configuration, it should be appreciated that sleeve 101 could act as an exterior barrier to protect container 103. In addition, sleeve 101 can be translucent or opaque to conceal the contents of container 103. However, if desired, sleeve 101 could be translucent to show contents that are stored in the container 103. Sleeve 101 has a generally cylindrical conformation, and likewise container 103 also has a generally cylindrical conformation. The sleeve 101 is dimensioned to receive the container 103 therein so that the cap 105 preferably does not appreciably extend outwardly from the sleeve when the container with assembled cap are received in the sleeve (see FIGS. 1 and 2). As shown in FIGS. 1 and 2, sleeve 101 has a slightly enlarged, second end that forms a bell mouth that accommodates a sidewall of the cap 105 when the cap is secured to container 103 and the container/cap assembly is disposed in the sleeve.

At the top portion, sleeve 101 comprises a plurality of ribs 102 (shown as axially extending, circumferentially spaced ribs that are located along an inner periphery of the bell mouth portion of the enlarged second end) that can engage with a plurality of ribs 109 of cap 105. The ribs 109 of cap 105 also have an axial dimension that are preferably circumferentially spaced about the outer perimeter of the sidewall of the cap. When container 103 is enclosed within sleeve 101 (e.g., FIGS. 1 and 2), it should be appreciated that the engagement between ribs 109 of cap 105 and ribs 102 of sleeve 101 engage or interfere with one another to preclude rotation of the cap when the container/cap assembly is locked in the sleeve, and that includes rotation relative to the container, and also relative rotation between the cap and the sleeve, and as a result prevents users from removing cap 105 from the container 103 by rotating cap 105. When sleeve 101 is removed from container 103, the ribs of sleeve 101 and the ribs of cap 105 can be interlocked by sliding cap 105 into sleeve 101 (FIG. 10A) and rotating at least one of sleeve 101 and cap 105 to tighten or loosen cap 105 relative to container 103.

It is contemplated that other mechanisms can be provided in place of the ribs 102, 109 on the sleeve and cap, respectively, to tighten or loosen cap 105 from container 103. For example, actuators or magnets can be used to mechanically rotate cap 105 from container 103. Moreover, it is contemplated that a single rib can be used on sleeve 101 and/or cap 105. In further embodiments, a user can simply rotate a portion of sleeve 101 that contains ribs 102, which interlock with cap 105 such that rotation of the entire sleeve 101 and/or cap 103 is not required. In yet further embodiments, another attachment can couple to sleeve 101 in order to gain more leverage to tighten or loosen cap 105 from container 103.

It should be appreciated that sleeve 101 can further include a friction surface to assist in the rotational motion to tighten or loosen cap 105 from container 103. In addition, sleeve 101 can include or be formed as a soft outer shell to assist those individuals that may have delicate hands.

At the bottom portion, sleeve 101 includes a locking mechanism 107 that removably couples, locks, or secures sleeve 101 and container 103 (or the container/cap assembly therein). Locking mechanism 107 may be any one of various types of locks including without limitation combination locks, cylinder locks, vending machine cam locks, electronic cam locks, and magnetic locks. FIG. 1 shows sleeve 101 having a vending machine style cam lock 107. In this embodiment, a vending machine lock key can be turned to project a locking member or striker 120 (FIG. 1) into a lock opening provided, for example, in a recess 122 formed in a partial peripheral portion at the bottom part 108 of container (see FIG. 3), which locks container 103 within sleeve 101. The striker 120 and recess 122 of the lock 107 also advantageously prevent relative rotation of the container 103 relative to the sleeve 101. Thus, in addition to the cap 105 being prevented from rotation due to the operative interaction of the ribs 102, 109 on the sleeve 101 and cap, respectively, the lock 107 also prevents rotation of the cap relative to the container, and prevents rotation of the container relative to the sleeve when the key is turned to the lock position. To unlock, a user simply turns vending machine lock key in an opposite direction which retracts the striker 120 radially inward and out of the recess 122 and thereby allows a user to slide out container 103 from the open end of the sleeve 101.

The lock is centrally located in the bottom portion of the sleeve and interacts with the container along a lower portion thereof. One skilled in the art will appreciate that the lock could be positioned at other locations of the sleeve, and likewise interact with other surface portions of the container to achieve the same locking arrangement of the container in the sleeve.

Container 103 can be sized and dimensioned to store a number of substances (e.g., medicine and medicinal substances, food, weapons, and other hazardous or non-hazardous substances). Container 103 can be opaque or translucent to hide the enclosed substances or transparent if it is desirable to see the internal contents of the container. In addition, container 103 can be composed of various metals and plastics of various strengths.

Figure 3:
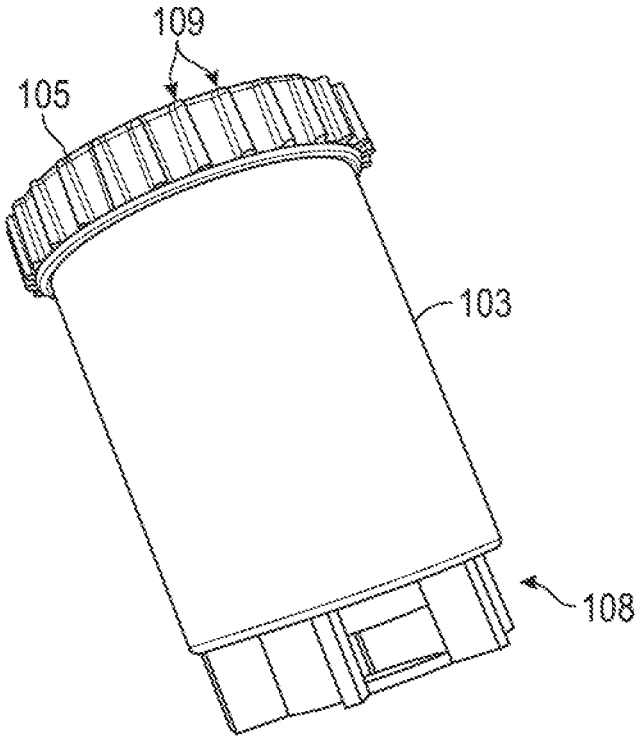
FIG. 3 is a perspective view of a container and cap assembly.

Cap 105 can be typically rotated onto container 103 via the use of threads that interlock (e.g., screw cap). Other types of fittings can also be used between cap 105 and container 103, such as a well known child-resistant fitting that requires compression and torque to remove a cap (e.g., medicine caps) from the container, and a tamper-resistant cap. Cap 105 has a plurality of ribs 109 disposed on an outer circumference of a sidewall of the cap 105 as shown in FIG. 3. As discussed above, ribs 109 can engage with ribs 102 of sleeve 101 for two purposes: first, to prevent rotation of the cap relative to the sleeve when the container/cap assembly is inserted in the sleeve, and second, to tighten or loosen cap 105 on container 103 when the container/cap assembly is rotated 180 degrees and the cap initially inserted into the sleeve.

Figure 4A:
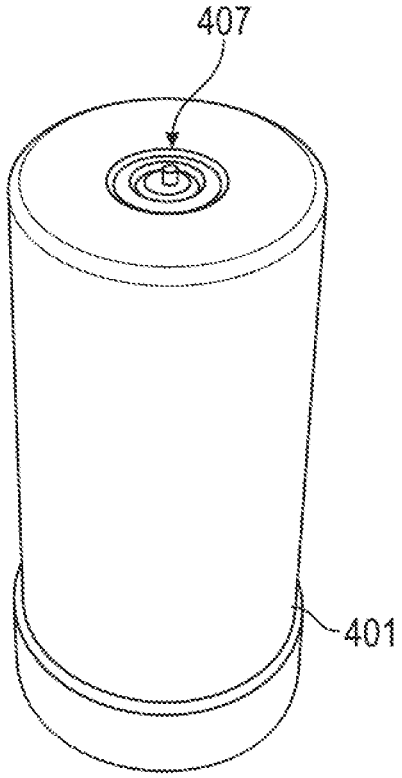
FIG. 4A is a perspective view of a bottom and side of a locking sleeve.
Figure 4B:
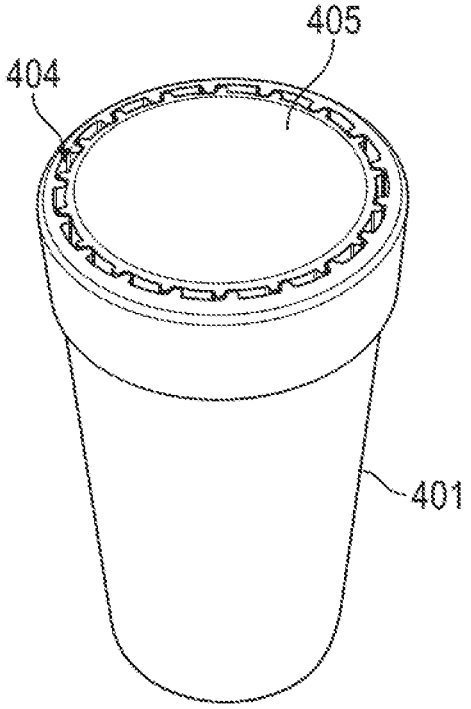
FIG. 4B is a perspective view of a top and side of the locking sleeve with a container and cap assembly received therein.
Figure 5:
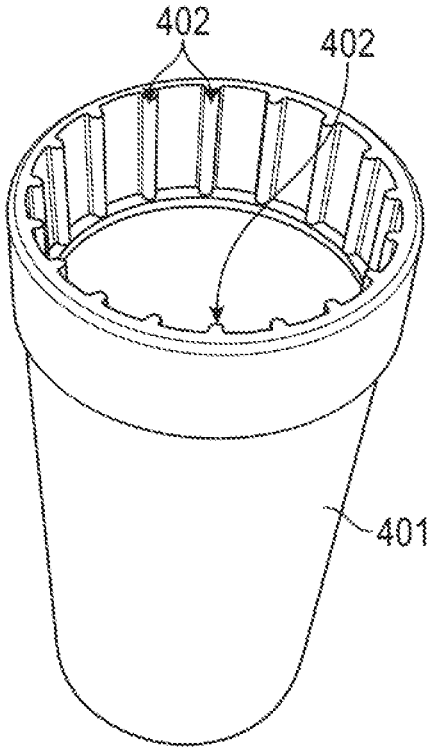
FIG. 5 is a perspective view of a top and side of an empty locking sleeve (i.e., without the container and cap assembly).
Figure 6:
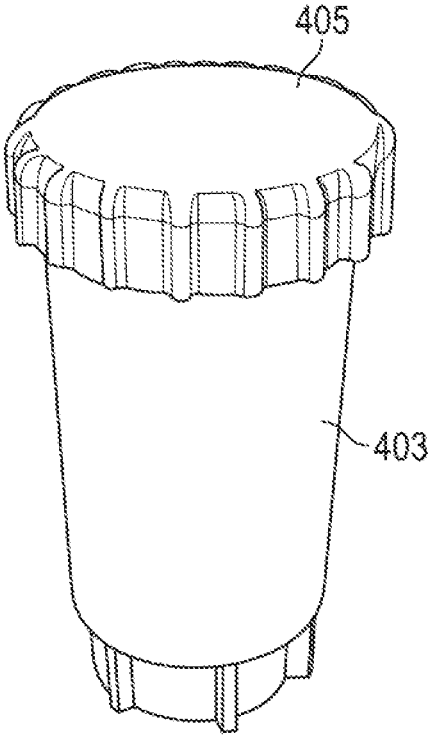
FIG. 6 is a perspective view of the container and cap assembly.

In another aspect, FIG. 4A shows a bottom perspective view of an embodiment of a secured storage apparatus having a sleeve 401 with a vending machine lock 407. FIG. 4B shows a top perspective view of the embodiment in FIG. 4A, which shows a cap 405 having a plurality of ribs 409 in spaced positions along a circumference of cap 405 that are interlocked with the ribs 402 on an inside surface of sleeve 101. Once locking vending machine lock 407 is unlocked, sleeve 101 and a container 403 with cap 405 can be separated as shown in FIGS. 5 and 6. FIG. 5 shows sleeve 401 with the plurality of ribs 402 disposed within a circumference of an inner surface of sleeve 401, particularly along the bell mouth portion of the sleeve that accommodates the cap 405.

Figure 7:
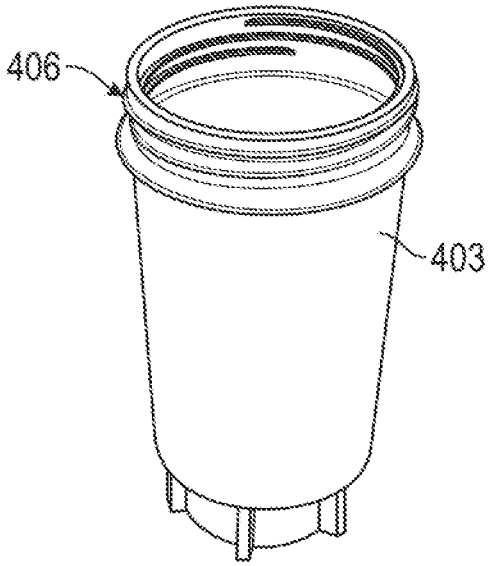
FIG. 7 is a perspective view of the container with the cap removed therefrom.
Figure 8:
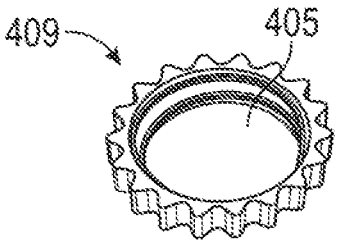
FIG. 8 is a perspective view of an underside of the cap.

FIG. 6 shows container 403 and cap 405, wherein cap 405 is coupled or assembled onto container 403. However, it is contemplated that container 403 and cap 405 can be separated as shown in FIGS. 7 and 8. As shown in FIG. 7, container 403 includes threads or thread portions 406 along an upper external surface thereof which can interlock with threads of cap 405 provided along an inner circumferential surface of the sidewall portion of the cap via a rotating motion. As described above, cap 405 includes a plurality of ribs 409 that can interlock with ribs 402 of sleeve 401.

Figure 9A:
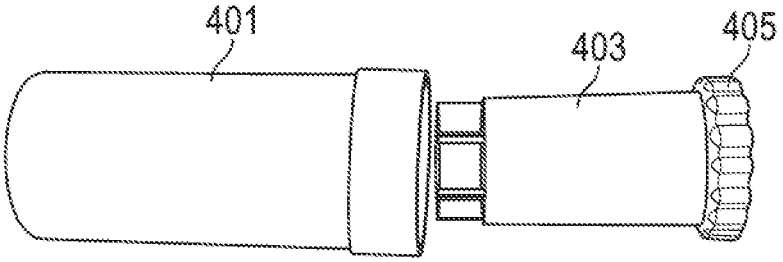
FIG. 9A is an elevational view of the container and cap assembly aligned for receipt within the sleeve.
Figure 9B:
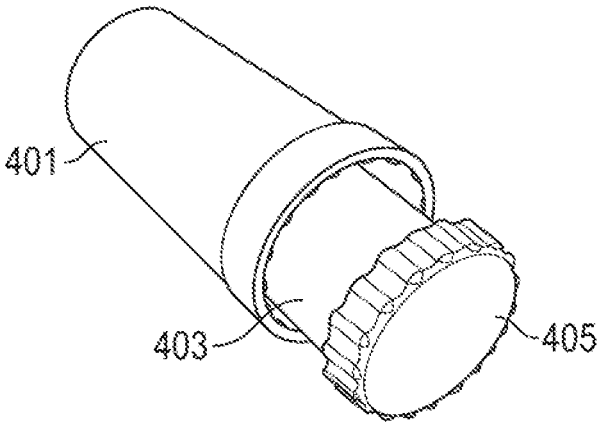
FIG. 9B is a perspective view of the container and cap assembly partially received within the sleeve.

In typical embodiments, container 403 and cap 405 can slide into sleeve 401 as shown in FIGS. 9A and 9B where the sleeve is dimensioned to receive the container therein, and the the bell mouthed portion of the sleeve receives the cap assembled on the container. It is contemplated that container 403 and cap 405 can simply slide into sleeve 401 or that container 403 and cap 405 require a specific orientation (e.g., rotation), such that a bottom portion of container must fit specifically into a portion of the locking mechanism to orient the striker 120 and recess 122 of the lock 107.

Figure 10A:
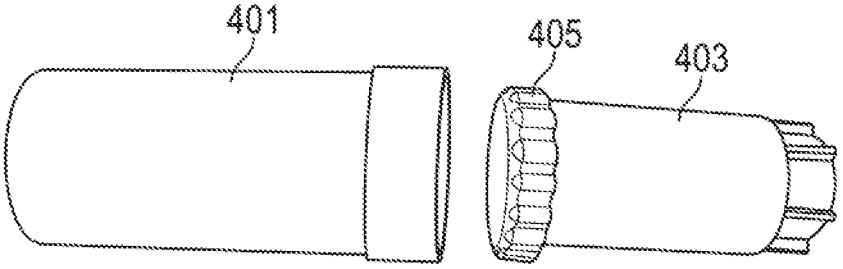
FIG. 10A is an elevational view of the container and cap assembly aligned for partial receipt within the sleeve, with the cap adjacent an open end of the sleeve.
Figure 10B:
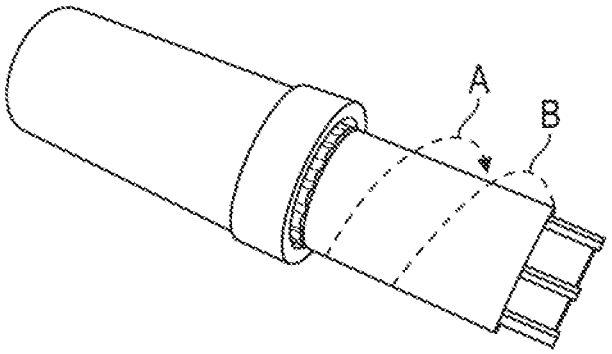
FIG. 10B is a perspective view schematically illustrating rotation of the container relative to the cap and sleeve.

FIGS. 10A and 10B show perspective views of sleeve 401, container 403, and cap 405 where sleeve 401 is used to aid in removal of the cap 405 from the container. As shown, cap 405 is inserted into sleeve 401 in a direction opposite of that shown in FIGS. 9A and 9B, i.e., the container and cap are oriented 180 degrees relative to the position of these components (compare FIGS. 9A and 10A). In contemplated embodiments, sleeve 401 has a bell mouth portion or ledge that prevents further axial advancement of the cap 405 and container 403 into the sleeve 401 in this direction. Once cap 405 is placed within sleeve 401, the ribs 402, 409 of each are interlocked with one another such that a rotational motion can create torque and remove or tighten cap 405 relative to the container 403. Typically, container 403 can be rotated in a clockwise rotation (A in FIG. 10B) to tighten cap 405 onto container 403. Conversely, container 403 can be rotated in a counterclockwise rotation (B in FIG. 10B) to loosen and/or remove cap 405 off container 403. In contemplated embodiments, the rotational configuration can be reversed such that clockwise rotation can loosen cap 405. Additionally, it should be appreciated that sleeve 401 can also be rotated to tighten or loosen cap 405 from container 403.

Figure 11:
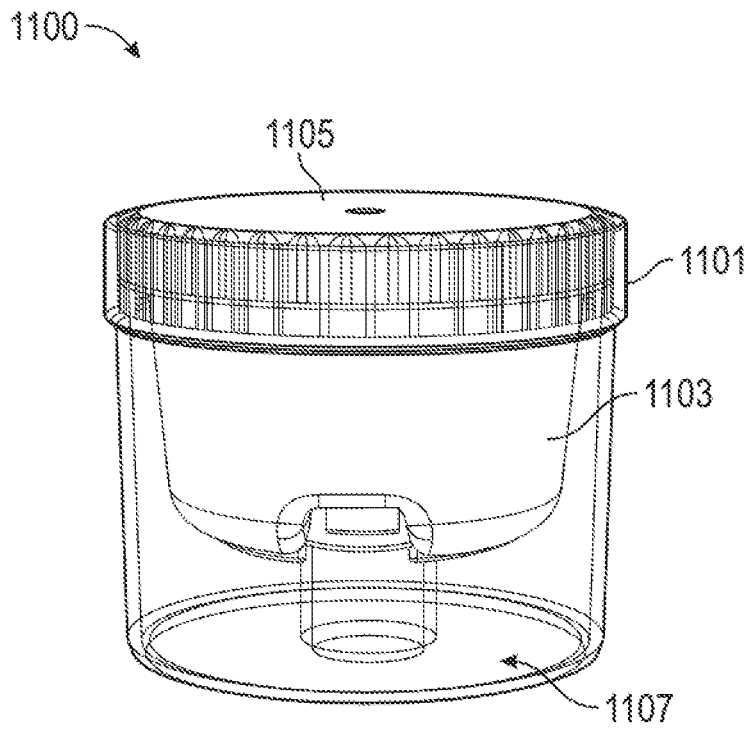
FIG. 11 shows another embodiment of a secured storage apparatus of a different dimension than the apparatus of FIG. 1.
Figure 12:
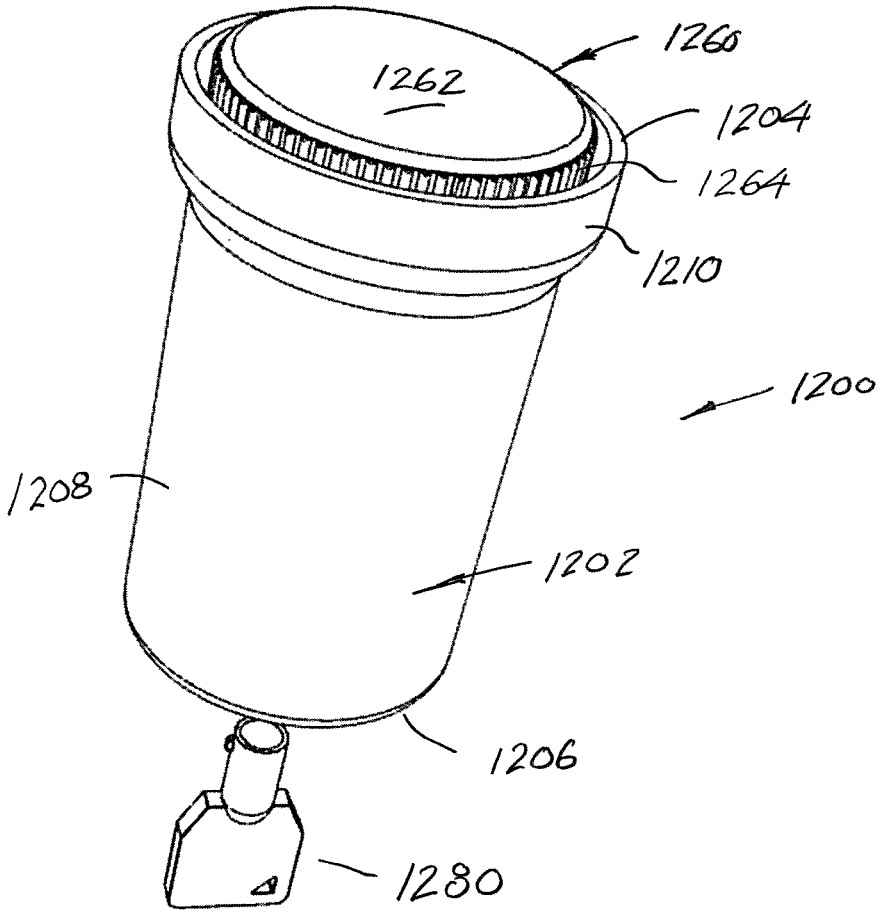
FIG. 12 shows another embodiment of a secured storage apparatus and that also illustrates the key for selectively locking and unlocking the container assembly in the sleeve.
Figure 13:
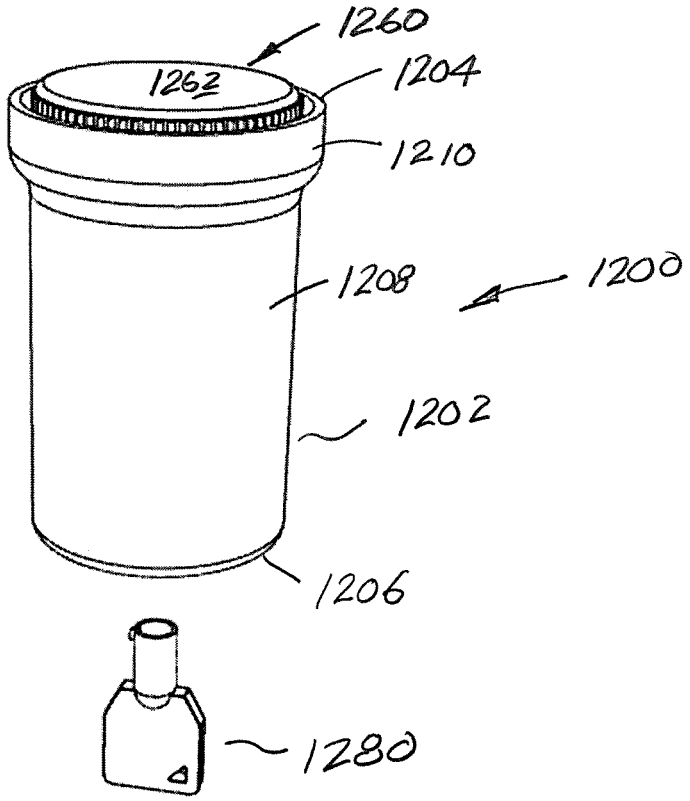
FIG. 13 is a front view of the embodiment of FIG. 12.
Figure 14:
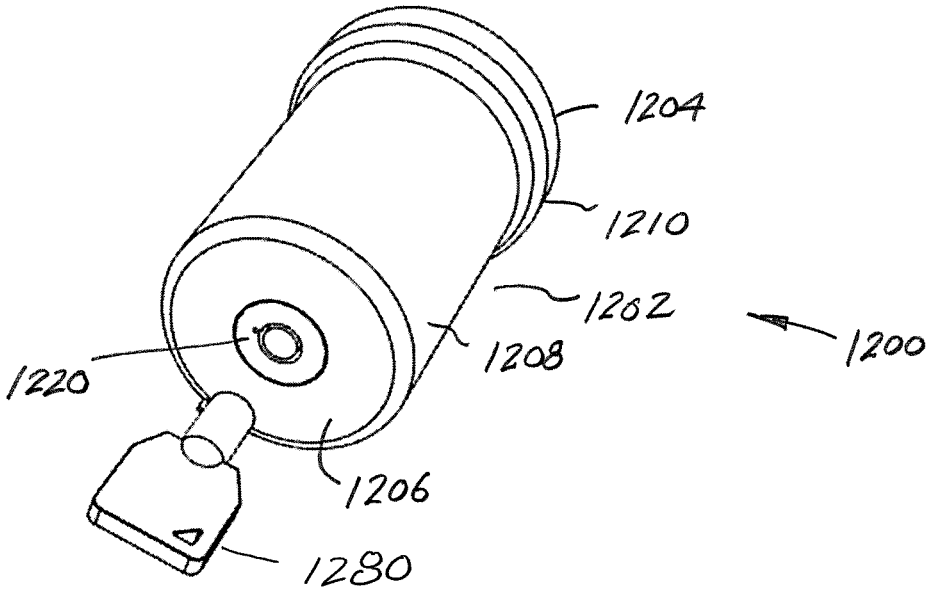
FIG. 14 is a bottom perspective view of the embodiment of FIG. 12.
Figure 15:
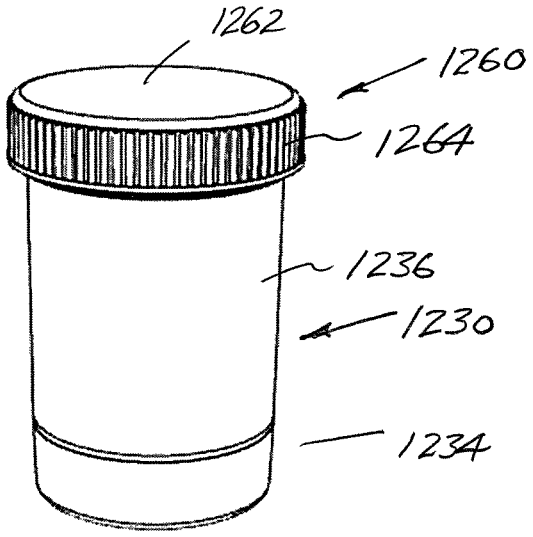
FIG. 15 is a front view of the container assembly used in the embodiment of FIG. 12.
Figure 16:
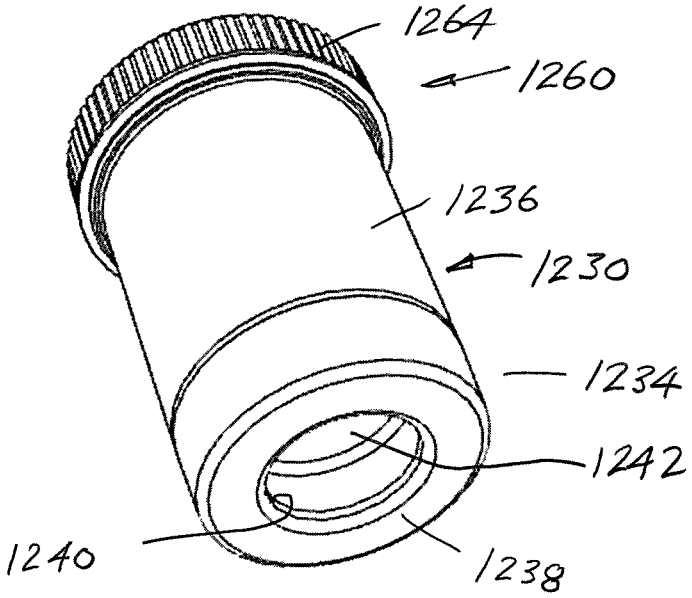
FIG. 16 is a bottom perspective view of the container assembly used in the embodiment of FIG. 12.
Figure 17:
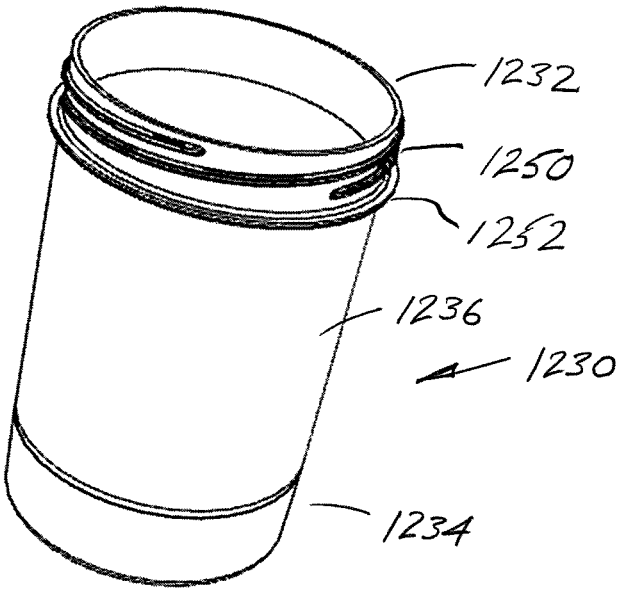
FIG. 17 is a top perspective view of the container with the cap removed as used in the embodiment of FIG. 12.
Figure 18:
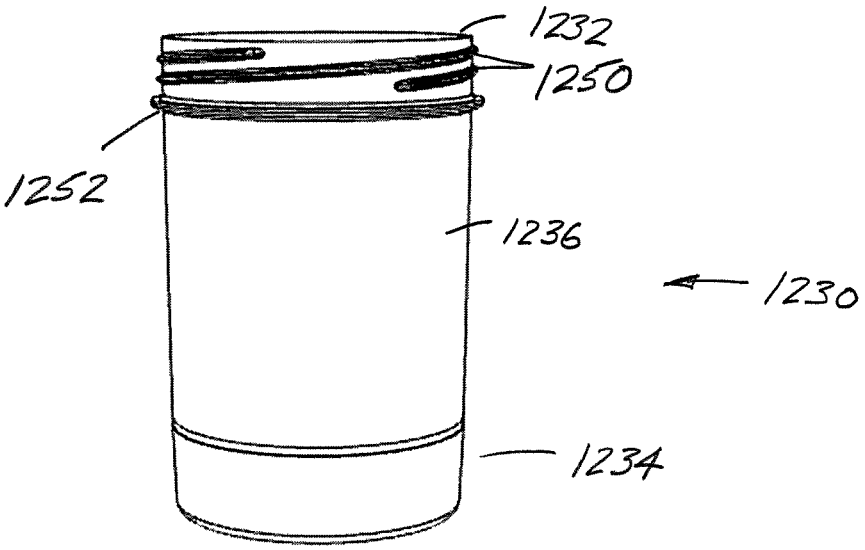
FIG. 18 is a front view of the container of FIG. 17.
Figure 19:
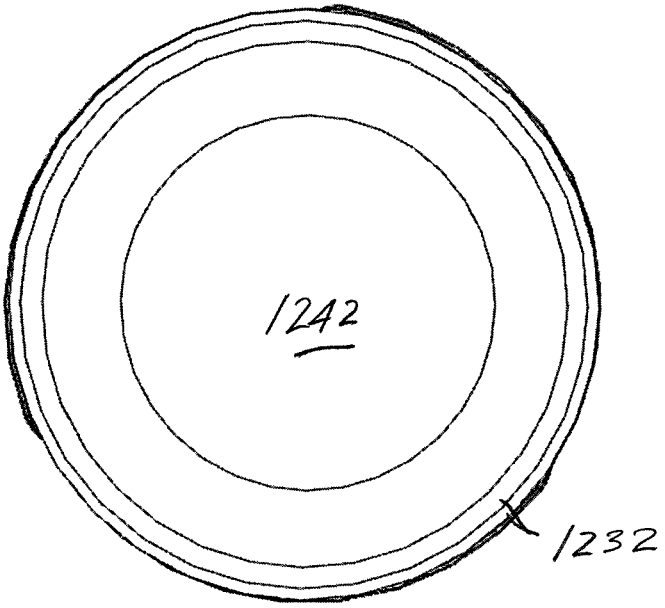
FIG. 19 is a top view of the container of FIG. 17.
Figure 20:
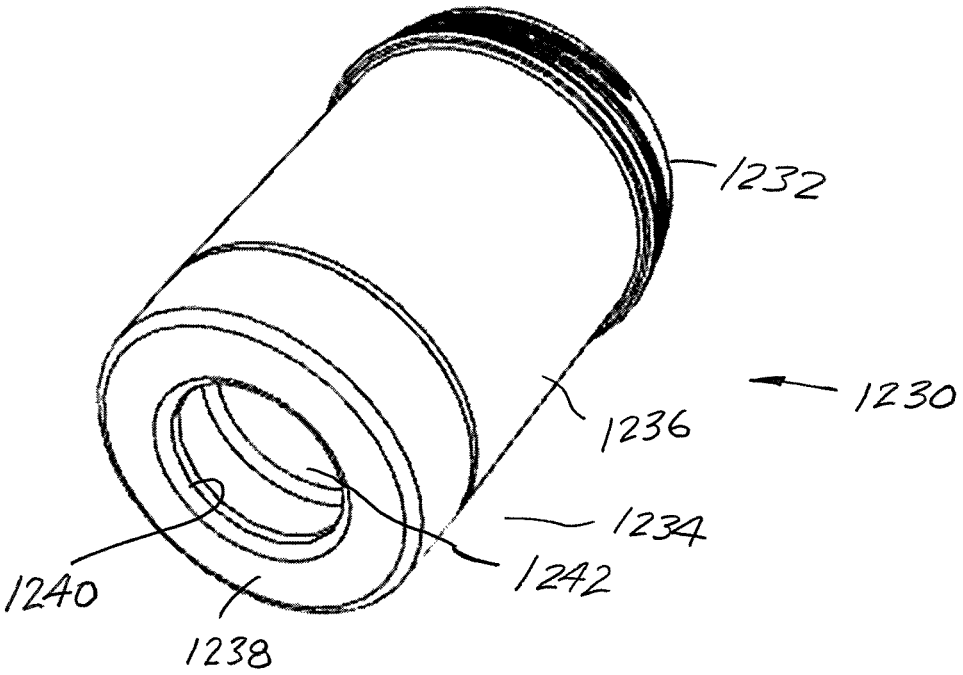
FIG. 20 is a bottom perspective view of the container of FIG. 17.
Figure 21:
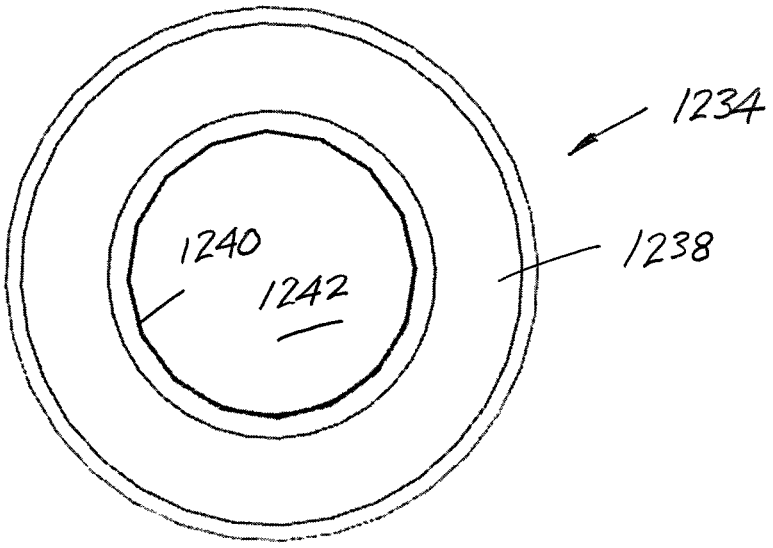
FIG. 21 is a bottom plan view of the container of FIG. 17.
Figure 22:
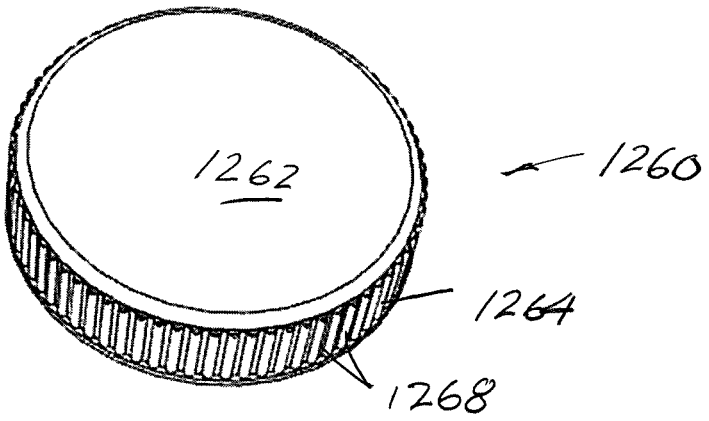
FIG. 22 is a top perspective view of the cap used in the embodiment of FIG. 12.
Figure 23:
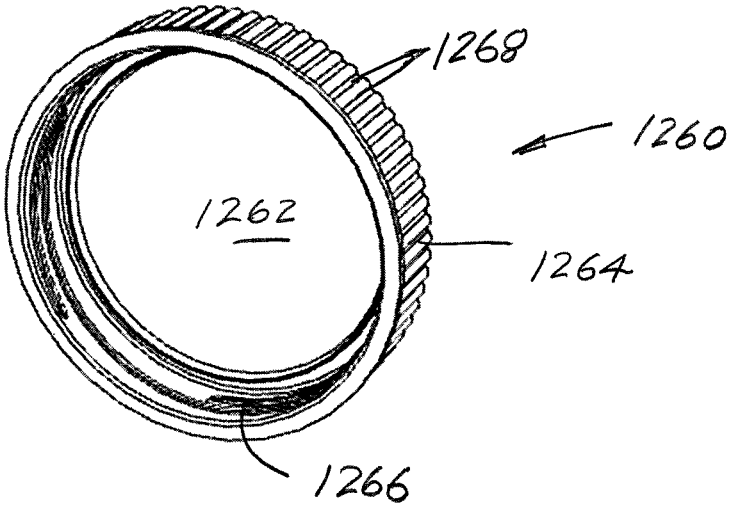
FIG. 23 is a bottom perspective view of the cap used in the embodiment of FIG. 12.
Figure 24:
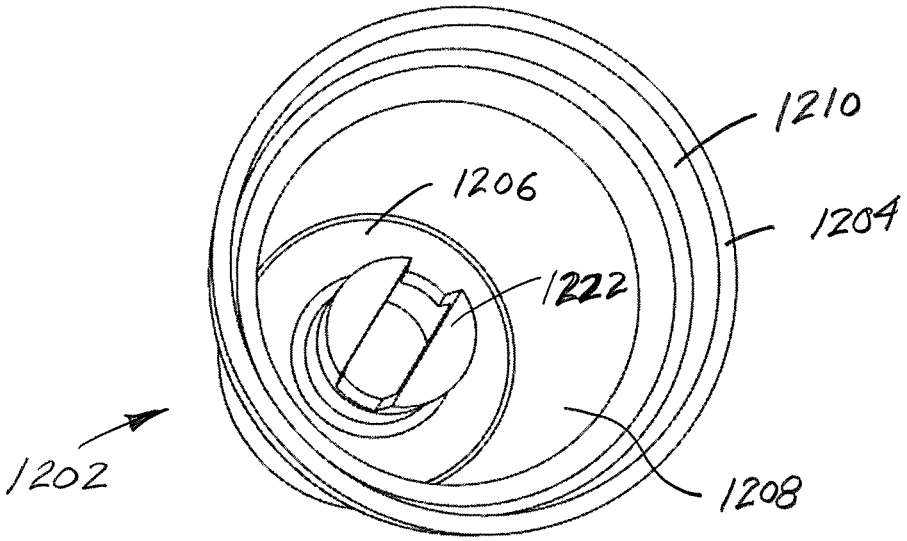
FIG. 24 is a top perspective view through an open end of the sleeve used in the embodiment of FIG. 12.
Figure 25:
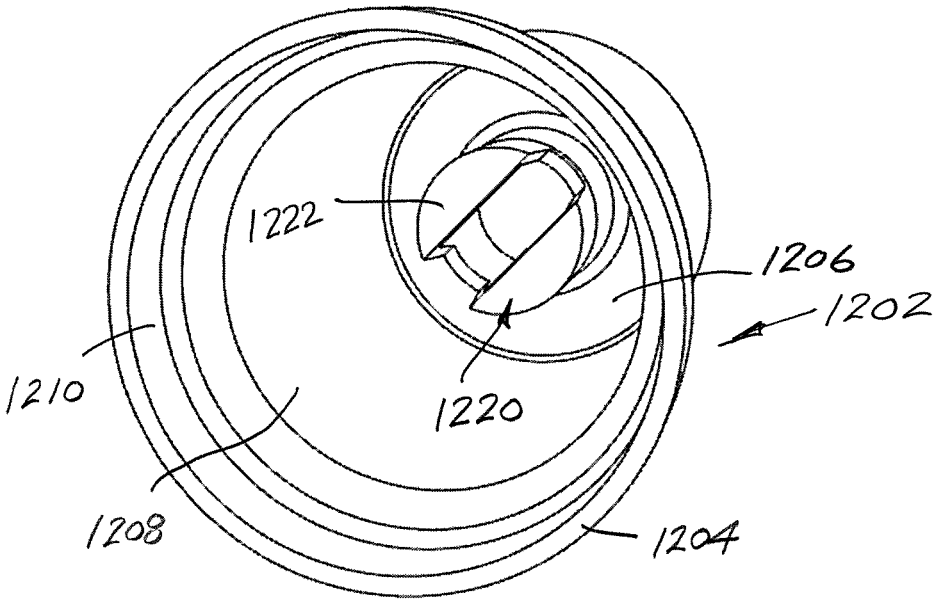
FIG. 25 is a top perspective view similar to FIG. 24.
Figure 26:
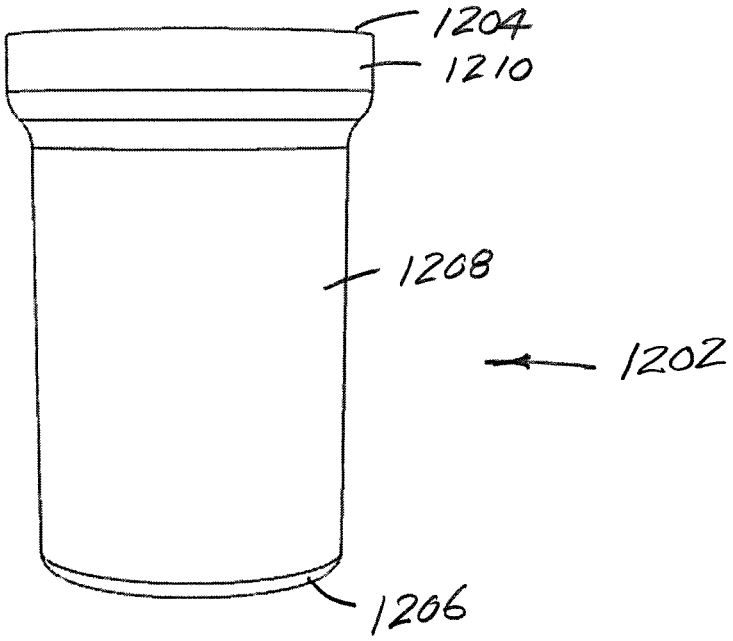
FIG. 26 is a front view of the sleeve used in the embodiment of FIG. 12.
Figure 27:
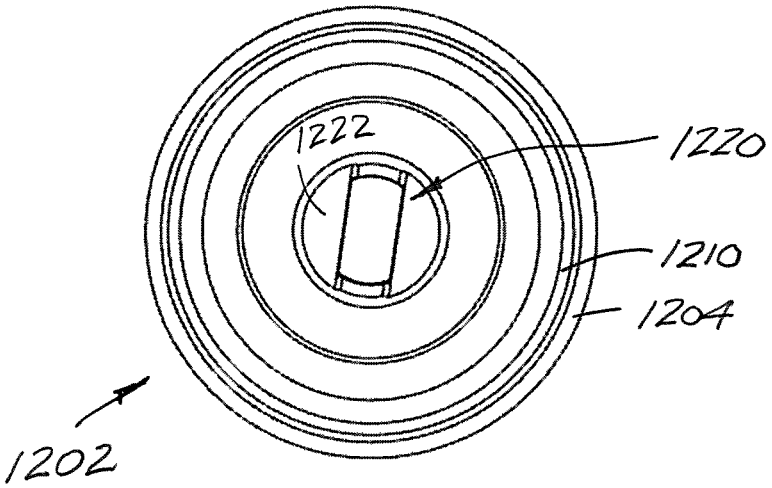
FIG. 27 is a top plan view of the sleeve used in the embodiment of FIG. 12.
Figure 28:
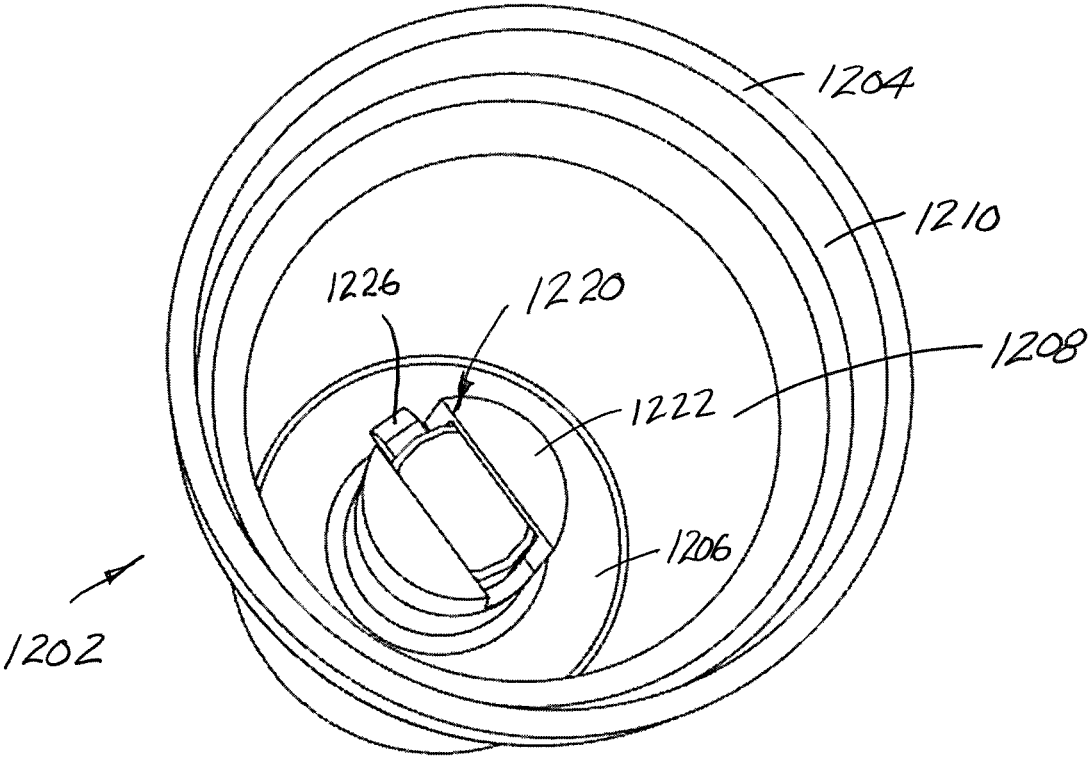
FIG. 28 is a top perspective view similar to FIG. 24.
Figure 29:
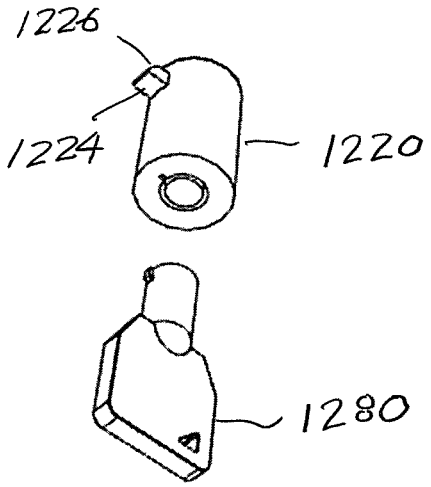
FIG. 29 shows the lock and key mechanism used in the embodiment of FIG. 12.
Figure 30:
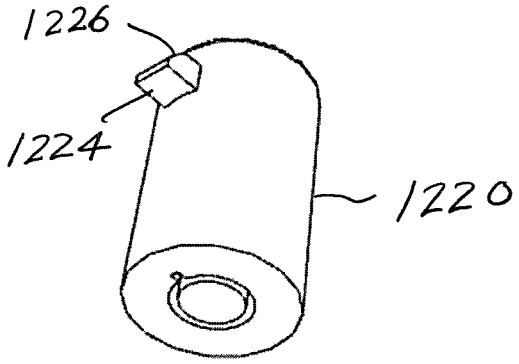
FIG. 30 is an enlarged perspective view of the lock mechanism used in the embodiment of FIG. 12.
Figure 31:
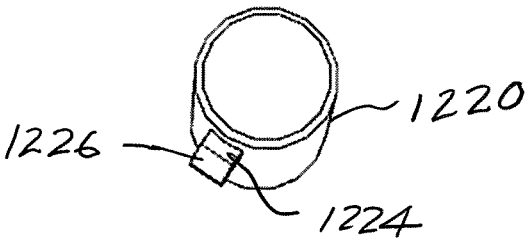
FIG. 31 is a top perspective view of the lock mechanism used in the embodiment of FIG. 12.
Figure 32:
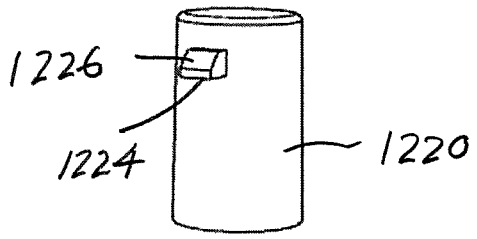
FIG. 32 is a front view of the lock mechanism used in the embodiment of FIG. 12.
Figure 33:
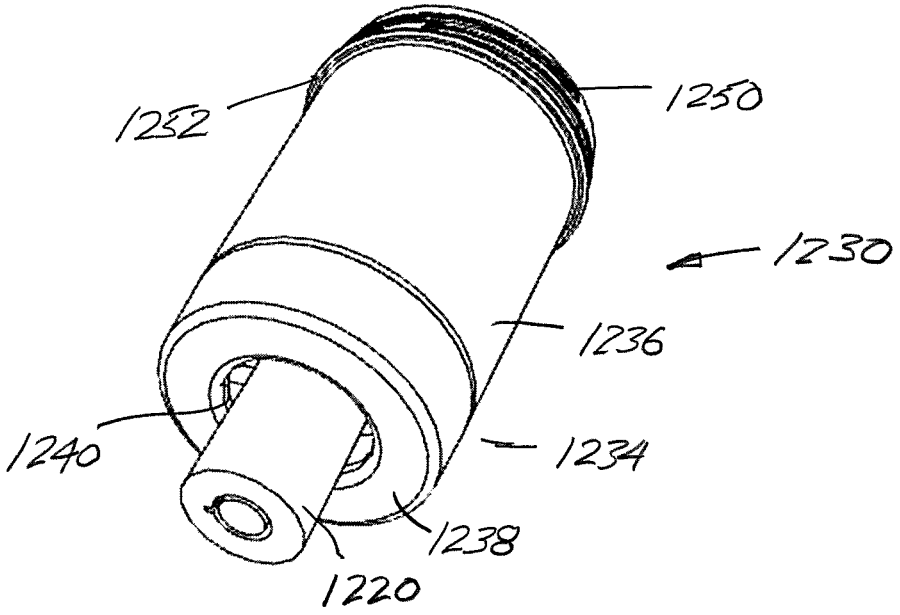
FIG. 33 is a bottom perspective view of the container, and how the container interacts with the lock mechanism.

In another aspect, FIG. 11 shows another embodiment of secured storage apparatus 1100. This embodiment is a larger container 1103 and a cap 1105, i.e. the container, cap and sleeve have a different aspect ratio relative to the earlier described embodiments. Similar to the embodiments shown and described above, sleeve 1101 is configured to receive container 1103 and cap 1105, and sleeve 1101 can lock onto container 1103 via a locking mechanism 1107. Additionally, sleeve 1100 has ribs, which could interlock with ribs of cap 1105 to tighten or loosen cap 1105 from container 1103.

In yet another aspect, the container and the cap include a second locking mechanism. In this embodiment, the sleeve can be used to unlock the cap from the container using a special fitting or a key. Furthermore, it is contemplated that the sleeve has a special chip wherein the cap cannot be removed from the container unless it is in close proximity to sleeve.

FIGS. 12-33 illustrate yet another embodiment of the present disclosure. More particularly, secured storage apparatus 1200 includes a generally cylindrically shaped outer sleeve 1202 (see FIGS. 13-14 and FIGS. 24-28) that has an upper, first, or open end 1204 and a lower, second, or closed end 1206. A sidewall 1208 extending between the first and second ends 1204, 1206 has a generally cylindrical conformation, although it will be understood that still other shapes and configurations could be adopted without departing from the scope and intent of the present disclosure. Again, the sleeve 1202 may be made from various materials, although a rugged plastic material is commonly used due to its inert characteristics and ease of molding/manufacture. The sleeve 1202 includes a bell mouth portion 1210 at the open end 1204, and a locking mechanism 1220 at the closed end 1206. The bell mouth portion 1210 of this embodiment has a smooth inner surface, i.e., the ribs used in the prior embodiments of FIGS. 1-11 have been removed for reasons which will become more apparent below.

The sleeve 1202 of the secured storage apparatus 1200 is appropriately dimensioned to receive a container 1230 (FIGS. 15-21) therein. More specifically, the container 1230 has an upper, first, or open end 1232 and a lower, second or closed end 1234 (FIGS. 17-21). Sidewall 1236 of the container 1230 is likewise a generally cylindrical conformation for receipt within the sleeve 1202, although the container may adopt other shapes or configurations as desired. As perhaps best illustrated in FIGS. 16, 20, and 21, the closed end 1234 has a locking recess shown as an annular wall 1238 formed by a central opening 1240. The annular wall 1238 is spaced axially outward from the end wall 1242, and cooperates with a locking mechanism in a manner to be described further below. Preferably, the annular wall 1238 has a generally planar outer surface that allows the container to rest on the corresponding planar surface without tipping. In addition, and as perhaps best illustrated in FIGS. 17 and 18, external threads or thread portions 1250 are provided on an external surface of the sidewall 1236, axially outward of a shoulder 1252, and adjacent the open, first end 1232 of the container 1230.

Cap 1260 (FIGS. 22-23) is assembled (i.e., screw threaded) onto the container 1230 to selectively close the internal cavity of the container, and retain container contents (not shown) therein. Like the container 1230, the cap 1260 is preferably made from a rugged plastic material due to its inert qualities and ease of molding/manufacture, although alternative materials may be used without parting from the scope and intent of the present disclosure. End wall 1262 of the cap 1260 has a sidewall 1264 extending axially outward from a perimeter portion thereof. Threads or thread portions 1266 are provided along the inner surface of the sidewall 1264 of the cap 1260, which allows the cap to be selectively secured to the container 1230. It will also be appreciated that the container/cap assembly may incorporate childproof or tamperproof characteristics as desired, the details of which are omitted from this description since the structure and operation thereof are well known to those skilled in the art. In addition, the outer surface of the cap sidewall 1264 may include ribs, knurls, or a textured surface 1268 to aid in grasping and turning the cap 1260 relative to the container 1230.

The lock 1220 is assembled into a mounting shoulder 1222 formed in the interior surface of end wall 1206 of the sleeve 1202 (FIGS. 24, 25, 27, and 28). The mounting shoulder is preferably centrally located in the end wall 1206 of the sleeve 1202 and extends axially toward the open end 1204 of the sleeve into the interior cavity defined by the sleeve sidewall 1208. The lock 1220 includes one or more projecting members or strikers 1224 (FIGS. 28-32) that selectively extend outward from the mounting shoulder 1222 a dimension greater than opening 1240 formed in the annular wall 1238 of the container when in the "locked" position, and are retracted radially inward to be essentially flush with the mounting shoulder 122 in the "unlocked" position. A key 1280 or other conventional actuator is used to selectively reposition the striker(s) 1224 from the locked to unlocked positions, or vice versa. Preferably, the striker(s) 1224 include a chamfer or tapered surface 1226 that face(s) the open end 1204 of the sleeve 1202 when the lock 1220 is mounted therein. The striker(s) 1224 are biased outwardly (for example, by a spring not shown) in the locked position, but will deflect radially inward if a sufficient force is imposed on the tapered surfaces 1226, and then snap radially outward again once the force is removed. In this manner, the container/cap assembly, or just the container 1230, may be axially inserted into the sleeve whether the lock 1220 is in a locked or unlocked position. The container 1230/cap 1260 assembly or container 1230 is axially advanced relative to the sleeve 1202 with sufficient insertion force, overcomes the biasing force so that the striker(s) deflect inwardly as the container opening 1240 continues to be axially advanced over the mounting shoulder 1222 and lock 1220, annular wall 1238 is advanced therepast, and then the striker(s) 1224 move radially outward to engage the container beneath the annular wall and thereby retain the container in the sleeve. To remove the container 1230 from the sleeve 1202, the lock 1220 is moved to the unlock position (by rotating the key 1280 to radially retract the striker(s) 1224). In addition, a spring or other outward biasing member may urge the container 1230 outwardly from the sleeve 1202 so that a user can more easily remove the container 1230/cap 1260 assembly or container 1230 from the sleeve. For example, a spring could be positioned in the sleeve 1202 for abutting engagement with the container 1230 when the container is inserted into the sleeve. In this manner, the spring is compressed upon container 1230 insertion, remains compressed while the container is locked in the sleeve 1202, and once the lock 1220 is unlocked, the spring urges the container outwardly from the cavity of the sleeve to assist a user in removing the container from the sleeve.

The annular wall 1238 cooperates with the striker(s) 1224 of the lock 1220 to allow the container 1230 to rotate relative to the sleeve 1202 when inserted therein and with the lock in a locked position. By using a child-proof cap that requires both compression and torque to remove the cap 1260 from the container 1230, the spacing of the annular wall 1238 from the end wall 1242, and the height of the mounting shoulder axially extending from the end wall 1206 of the sleeve assures that a user cannot open the cap relative to the container when the container is locked in the sleeve. Instead, the container 1230 and cap 1260 rotate together as a unit (and not relative to one another since the required compression of the cap relative to the container cannot be achieved) and the contents stored in the container remain secure until such time as the container/cap assembly is removed from the sleeve by unlocking the lock 1220 with the key 1280. The container and cap of the assembly freely rotate together in assembled relation within the sleeve, but the cap cannot be rotated relative to the container and/or pushed axially relative to the container (both actions of which are required to open the child proof cap).

It is should be apparent to those skilled in the art that many more modifications besides those already described are possible without departing from the inventive concepts herein. This disclosure, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A secured storage apparatus, comprising:
a container;
a cap configured to removably couple with the container;
a sleeve, wherein the container is slideably coupled to an inside area of the sleeve; and
a locking mechanism configured to removably couple the sleeve and the container and prevent removal of the cap from the container when the cap and container are locked in the sleeve, wherein the locking mechanism coupling the sleeve and container is spaced from the cap.

2. A secured storage apparatus, comprising:
a container;
a cap configured to removably couple with the container;
a sleeve; and
a locking mechanism configured to removably couple the sleeve and the container and prevent removal of the cap from the container when the cap and container are locked in the sleeve, wherein the locking mechanism coupling the sleeve and container is spaced from the cap and the locking mechanism further includes a plurality of ribs on the sleeve and a plurality of ribs on the cap, the ribs of the sleeve and the cap are configured to interlock such that a rotation of the sleeve removes the cap from the container when the container is outside the inside area of the sleeve.

3. The apparatus of claim 2, wherein the plurality of ribs of the sleeve and the plurality of ribs of the cap are configured to interlock such that a rotation of the sleeve couples the cap to the container when the container is outside the inside area of the sleeve.

4. The apparatus of claim 1, wherein the container is at least one of a metal and a plastic.

5. The apparatus of claim 1, wherein the cap and the container comprise of a same material.

6. A secured storage apparatus, comprising:
a container;
a cap configured to removably couple with the container;
a sleeve; and
a locking mechanism configured to removably couple the sleeve and the container and prevent removal of the cap from the container when the cap and container are locked in the sleeve, wherein the locking mechanism coupling the sleeve and container is spaced from the cap, wherein the cap and the container are removably coupled by a twisting motion.

7. The apparatus of claim 1, wherein the sleeve comprises a metal.

8. A secured storage apparatus, comprising:
a container;
a cap configured to removably couple with the container;
a sleeve; and
a locking mechanism configured to removably couple the sleeve and the container and prevent removal of the cap from the container when the cap and container are locked in the sleeve, wherein the locking mechanism coupling the sleeve and container is spaced from the cap, wherein the sleeve is sized and dimensioned to receive the container and the cap.

9. A secured storage apparatus, comprising:
a container;
a cap configured to removably couple with the container;
a sleeve; and
a locking mechanism configured to removably couple the sleeve and the container and prevent removal of the cap from the container when the cap and container are locked in the sleeve, wherein the locking mechanism comprises a vending machine lock.

10. The apparatus of claim 2, wherein the sleeve has a plurality of ribs configured to engage the plurality of ribs of the cap.

11. A secured storage apparatus, comprising:
a container;
a cap configured to removably couple with the container;
a sleeve; and
a locking mechanism configured to removably couple the sleeve and the container and prevent removal of the cap from the container when the cap and container are locked in the sleeve, wherein the locking mechanism is centrally disposed on a bottom wall of the sleeve and extends into a cavity of the sleeve for selective engagement with the container.

12. A secured storage apparatus, comprising:

a container having opposed first and second ends, an end wall provided at the first end and a sidewall extending therefrom toward the second end which is open;

a cap dimensioned for selective closing receipt with the second end of the container;

a sleeve having opposed first and second ends, at least one of the ends being open and dimensioned to receive at least major portions of the container and cap therein; and the locking mechanism selectively locking the sleeve over major portions of the container and cap, the locking mechanism configured to removably couple the sleeve and the container and prevent removal of the cap from the container when the cap and container are locked in the sleeve, wherein the locking mechanism coupling the sleeve and container is spaced from the cap.

13. The apparatus of claim 12 wherein the cap and container include cooperating thread portions that allow the cap to be threadedly secured and removed from the container.

14. The apparatus of claim 13 wherein the container includes thread portions at the open, second end.

15. The apparatus of claim 14 wherein the container thread portions are located on an outer surface of the sidewall.

16. The apparatus of claim 15 wherein the container has a shoulder and the locking mechanism has a striker, the shoulder and striker having a first, locked state in a first position of the striker and a second, unlocked state in a second position of the striker.

17. The apparatus of claim 12 wherein the locking mechanism is mounted in an end wall of the sleeve.

18. The apparatus of claim 17 wherein the locking mechanism includes a portion extending from the sleeve end wall.

19. The of claim 18 wherein the container end wall includes an opening dimensioned for receipt over the locking mechanism portion extending from the sleeve end wall.

20. The apparatus of claim 19 wherein the container end wall opening is dimensioned for rotating receipt over the locking mechanism portion extending from the end wall so that the container can freely rotate relative to the sleeve when received therein.

21. The apparatus of claim 20 wherein the container end wall opening and the locking mechanism portion extending from the sleeve end wall allow the container to freely rotate relative to the sleeve in the locked state of the locking mechanism.

22. The apparatus of claim 12 wherein the container has a shoulder and the locking mechanism has a striker with a chamfered end that permits the shoulder to pass over the striker in a first, container insertion direction, and prevents the shoulder from passing over the striker in an opposite, second, container removal direction.

23. The apparatus of claim 22 wherein the locking mechanism further includes a first biasing member for urging the striker in a first direction toward engagement with the container shoulder.

24. The apparatus of claim 23 further comprising a second biasing member in the sleeve for urging the container outwardly from the sleeve.

25. The apparatus of claim 24 wherein the second biasing member is a spring extending outwardly from an end wall of the sleeve for urging the container toward the open end of the sleeve.

26. The apparatus of claim 12 wherein the sleeve includes a first, open end and a second, closed end, the sleeve having a sidewall length dimensioned to receive the container and cap therein when the cap is closed on the container.

27. The apparatus of claim 26 wherein the locking mechanism includes a portion extending from the sleeve end wall, and the container end wall includes an opening dimensioned for receipt over the locking mechanism portion extending from the sleeve end wall that allows the container to freely rotate relative to the sleeve in the locked state of the locking mechanism.

28. The apparatus of claim 27 wherein the container has a shoulder and the locking mechanism has a striker with a chamfered end that permits the shoulder to pass over the striker in a first, container insertion direction, and prevents the shoulder from passing over the striker in an opposite, second, container removal direction.

29. The apparatus of claim 28 wherein the locking mechanism further includes a first biasing member for urging the striker in a first direction toward engagement with the container shoulder.

30. The apparatus of claim 29 further comprising a second biasing member in the sleeve for urging the container outwardly from the sleeve.

31. The apparatus of claim 30 wherein the second biasing member is a spring extending outwardly from an end wall of the sleeve for urging the container toward the open end of the sleeve.

* * * * *